United States Patent [19]

Gergö et al.

[11] Patent Number: 4,558,748

[45] Date of Patent: Dec. 17, 1985

[54] METHOD AND EQUIPMENT FOR BORING AND CASING AIR VENT HOLES AND/OR DELIVERY HOLES IN MEDIUM-STEEP AND STEEP DIP COAL DEPOSITS AND ROCKS OF LOOSE STRUCTURE

[75] Inventors: György Gergö, Pécs; József Németh, Budapest; Béla Sebestyén, Pécs; Zoltán Vida, Komló, all of Hungary

[73] Assignees: Gepipari Technologiai Intezet, Budapest; Mecseki Szenbanyak, Pécs, both of Hungary

[21] Appl. No.: 693,314

[22] Filed: Jan. 22, 1985

Related U.S. Application Data

[63] Continuation of Ser. No. 515,363, Jul. 19, 1983, abandoned.

[30] Foreign Application Priority Data

Jul. 20, 1982 [HU] Hungary ..... 2347/82

[51] Int. Cl.[4] ..... E21B 19/00

[52] U.S. Cl. ..... 175/57; 175/171; 173/152

[58] Field of Search ..... 175/57, 171; 299/31, 299/53, 55; 173/149, 152

[56] References Cited

U.S. PATENT DOCUMENTS 3,174,562 3/1965 Stow ..... 175/171

4,179,001 12/1979 Still et al. ..... 175/171

4,248,312 2/1981 Jinno et al. ..... 175/171

4,421,175 12/1983 Boyadjiett et al. ..... 175/171

*Primary Examiner*—Stephen J. Novosad

*Assistant Examiner*—William P. Neuder

*Attorney, Agent, or Firm*—Karl F. Ross; Herbert Dubno

[57] ABSTRACT

Forming a hole between lower and upper parallel galleries formed in a mine by boring upwardly from the lower gallery a bore hole having a first length equal to a fraction of the distance between the lower and upper galleries, then casing the bore hole by thrusting upwardly at least one pipe section having a diameter sufficient to be gripped by the shrinkage of the bore hole into the bore hole. Boring upwardly after casing the first length by a further length equal to a fraction of the distance between the lower and upper galleries, then casing the newly formed further length of the bore hole by thrusting upwardly at least one further pipe section having a diameter less than the inside diameter of any pipe sections previously disposed in the bore hole and sufficient to be gripped by the shrinkage of the newly formed further length of the bore hole through the any previously disposed pipe sections into the newly formed further length of the bore hole, and then repeating the two previous steps of boring a further length and casing the newly formed further length until the upper gallery is reached.

1 Claim, 3 Drawing Figures

METHOD AND EQUIPMENT FOR BORING AND CASING AIR VENT HOLES AND/OR DELIVERY HOLES IN MEDIUM-STEEP AND STEEP DIP COAL DEPOSITS AND ROCKS OF LOOSE STRUCTURE

This is a continuation of co-pending application Ser. No. 515,363 filed on July 19, 1983, now abandoned.

FIELD OF THE INVENTION

The invention relates to a method of and to an apparatus for boring and casing air vent holes and/or delivery holes, principally in medium-steep and steep dip coal deposits and rock strata of loose structure.

BACKGROUND OF THE INVENTION

In the case of medium-steep and steep dip coal deposits of loose structure, supported air vent holes and/or delivery holes cannot be formed at all with the aid of hitherto employed methods and apparatus, because the bore holes tend to constrict or cave-in promptly. The hills up the dip however can be formed exclusively by advance from above downwards, while carrying the coal masses upwards; this operation requires intensified precautions, and in the degree of advancing or deepening the entry, is increasingly difficult; it demands increasing amounts of live labor, apparatus and power.

OBJECT OF THE INVENTION

The invention is to eliminate the above difficulties and insufficiencies and to provide a convenient method of and apparatus for rapid and safe boring of air vent holes or delivery holes. In this connection, the fundamental problem is to hinder the caving of the bore holes in the coal deposits of loose structure.

SUMMARY OF THE INVENTION

The invention is based in the first place on the recognition that if an air vent or delivery hole between two parallel galleries is bored from the bottom upwards, caving-in of the bore hole or its constricting can be hindered if the bore crown is followed directly or at a small distance by casing pipe sections in the hole immediately after boring this hole, having a length equal to a fraction of the distance between the galleries, and these casing pipe sections are pushed up to the bore crown and fixed there by the shrinking of the bore hole.

The primary condition of achieving this aim is the fixation of the bore crown and its adherent bore rod, and hindering the backslide of the pushed casing pipes after completed boring of each section of the bore hole, using adequate machinery for this purpose. The length of each bore section is determined by the bore rod length, and along the prepared bore section, the setting in of the casing must be performed before caving in or shrinkage of the hole.

In coal deposits of very loose structure or in their secondary rocks, boring particularly long air vent and/or delivery holes is an especially difficult problem. However, this problem can also be resolved by applying a modified variation of the method according to the invention, if a staggered casing method is applied, i.e. if the supporting is performed from casing sections with upwards decreasing diameter. This method has the advantage that the force required for advancing and for pushing in the casing can be decreased essentially, while forming and supporting very long delivery and/or air vent holes can be carried out in deposits of very loose structure. After boring out and casing with the first pipe section of large diameter, in the next operation the casing is performed with pipes of smaller diameter until the next boring section, in the manner that two coaxial casing series are present, one with larger and one with smaller diameter. Then in the next boring section only the casing pipe of smaller diameter will be pushed upwards, so the unit advancing the casing pipe series has to overcome only the clamping-thrusting force from the friction resistance appearing on the interior pipe tract from the shrinking of the loose structure material. In the case of applying multiple-stepped, staggered casing sections, practical discretional boring or casing length can be performed with merely the casing diameters being chosen suitably, so that the casing pipe sections with decreasing diameter can get through the preceding casing pipe section, and casing pipes with the smallest diameter should not hinder the moving of the bore rod.

This means that galleries at very large distances can be connected with the aid of the method according to the invention caving of the bore hole or without jamming of the bore rod.

The method according to the invention shall continuously perform the following functions:

boring, that is the rotation and the advance of the bore crown together with the bore rod;

insertion of the bore rod extensions;

raising and advancing the casing pipes beneath the bore crown during or after boring; and fixation of the bore rod and of the casing pipes after completion of each boring section during preparation of the next boring section.

The apparatus comprises a bore machine, an advancing unit for the bore machine, an elevating unit for casing pipes, and clamping-fastening cylinders for the bore rod and for the casing pipes, all of which are mounted on a common frame.

The bore crown of the bore machine is advantageously a composite tool which divides the hole to be bored into several parts, and thus it facilitates more easily the boring process.

The bore machine is driven by a high pressure air unit. The elevation of the casing pipes is executed by telescopic hydraulic cylinders. When completing each boring section the clamping and temporary fastening of the casing pipes and that of the bore rod is executed also by hydraulic units. A slideway steel structure is formed for arranging and moving these units.

Thus the invention permits safe, rapid and economical connection of galleries or sublevel roadways situated on different levels.

The bore hole formed and supported according to the invention, used as an air vent hole, accomplishes the safe aeration of the galleries or mining banks, while used as delivery hole, it facilitates the lowering through the casings, from above downwards, the coal masses winnowed by gallery driving. The invention eliminates the difficulties existing previously during gallery deepening, and results in important savings in live labor and in energy, while increasing to a great extent the drift work rate and its economies.

BRIEF DESCRIPTION OF THE DRAWING

The invention will now be described by way of example with reference to the accompanying drawing, in which.

SPECIFIC DESCRIPTION

Figure 1:
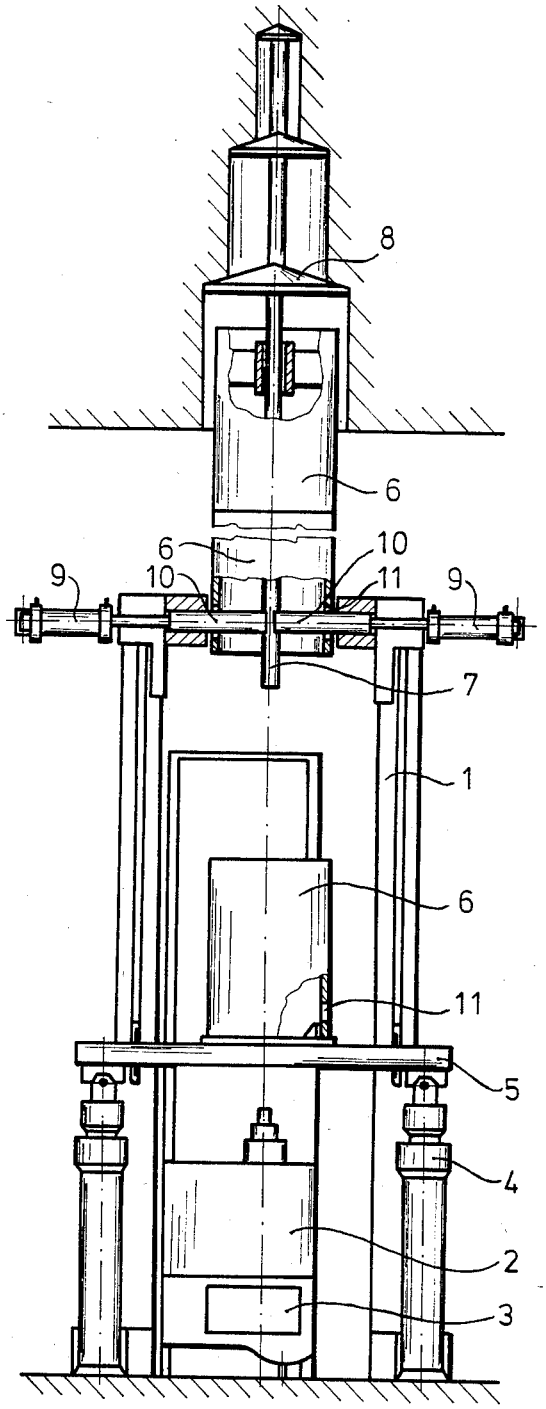
FIG. 1 is a side view of the apparatus for carrying out the method according to the invention in an initial period of the boring process.

Referring now to FIG. 1, the boring machine 2 and the advancing unit 3 for boring machine 2 are disposed within the frame 1, and they are guided on two guides fastened to the frame 1. On the sides of the frame 1 two actuating hydraulic cylinders are arranged for elevating a joint plate 5 and a casing pipe 6 situated on this plate 5. A bore rod 7 is arranged in the interior of the elevated casing pipes 6 of the casing series, to the higher end of which a composite bore crown 8 is joined. The common fastening of the bore rod 7 and the casing pipe 6 is accomplished by the fastenings 10 threaded to the end of the piston rod in the actuating cylinders 9 arranged horizontally on the frame 1 such that these fastenings 10 are suitable for gripping or fixing the bore rod 7 through an aperture or fastening hole on the casing pipes 6 and also for holding the casing pipes through this aperture. The actuating cylinders 9 have three positions: the first one for gripping the bore rod 7, the second (middle) one for gripping the casing pipe 6 and the third position for full releasing. Another possible variant of the equipment shown in FIG. 2 differs from the variant illustrated in FIG. 1 in that there is no aperture in the casing pipes 6; in this case the fastening of the casing pipes 6 is performed by the clamps 13 of the actuating cylinders 12, while the gripping of the bore rod 7 by the fastenings 15 of the actuating cylinders 14.

Figure 3:
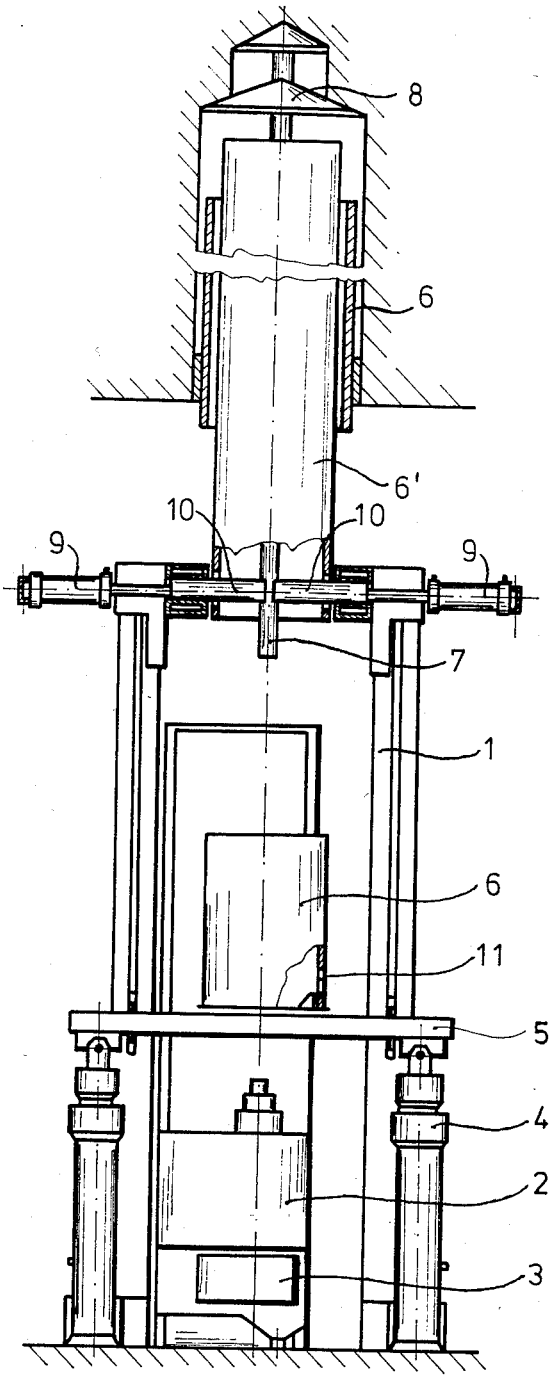
FIG. 3 is a side view of the fundamental embodiment of the apparatus in a later phase of the boring with staggered casing.

A sectional casing method is illustrated in FIG. 3 with a casing pipe diameter decreasing step-by-step. An inner casing section of smaller diameter 6′ is planted in the outer casing section of larger diameter 6. The equipment can be arranged in the manner that the advancing unit 3 is not used, and the advancing of the boring machine 2 is executed by the hydraulic actuating cylinders 4.

Figure 2:
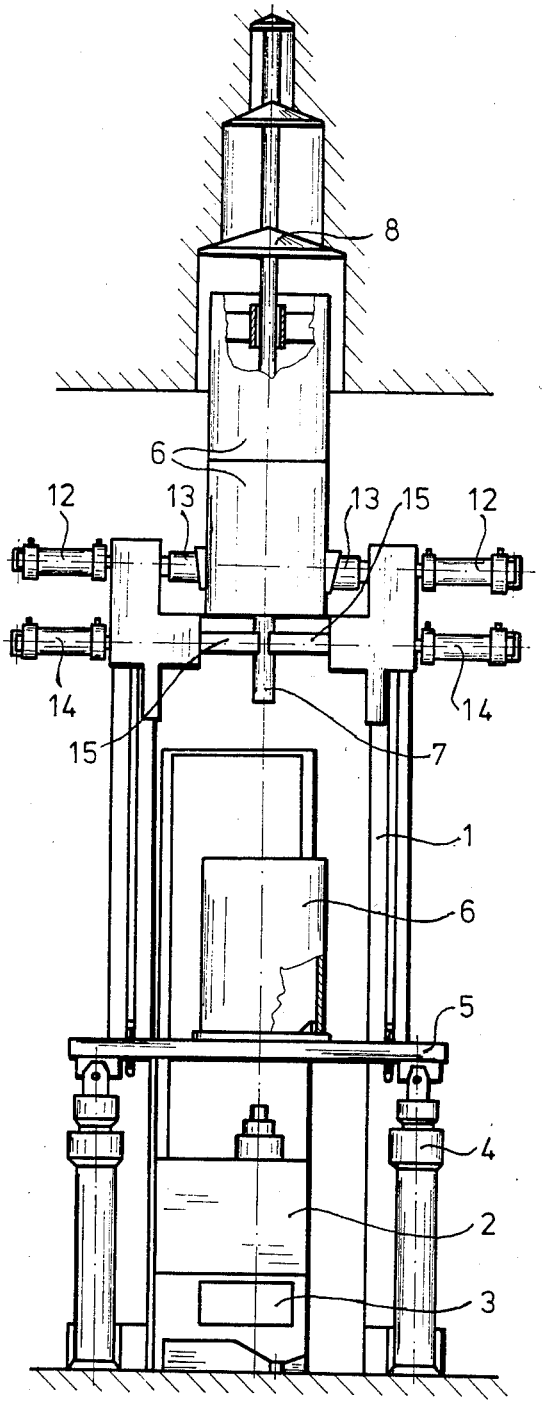
FIG. 2 is a side view of another embodiment of the apparatus with modified fastening of the casing pipes and the bore rod.

The one variant of the method according to the invention will now be described with reference to FIGS. 1 and 2.

The first bore rod 7 is set in the head of the boring machine 2, then the bore crown 8 is set on the bore rod 7, the driving engine of the boring machine 2 and of the advancing unit 3 is started, thus a hole corresponding in length to the length of the first bore rod 7 will be bored. The first bore rod 7 will be fixed by the cylinders 9 and fastenings 10, then the boring machine 2 and the advancing unit 3 will be returned to their zero-setting. Then the first casing pipe 6 of the first boring section will be inlayed on the joint plate 5, the second (extension) bore rod 7 will be set in the first casing pipe 6 of the first boring section, this extension bore rod 7 will be joined to the first bore rod 7 by the aid of advancing unit 3, so that a connection is formed between the two bore rods 7. Then the fastening of these bore rods 7 will be released, and the casing pipe 6 on the joint plate 5 will be pushed up by the hydraulic cylinders 4 and fixed by fastenings 10 of cylinders 9. Now another casing pipe 6 will be pushed up on joint plate 5 by the actuating cylinders 4 until the preceding casing pipe 6. Then these two touching casing pipes 6 will be connected by means of hooks not illustrated on the figures. Now the fastenings 10 will be drawn out by the cylinders 9, whereby the fixing of the casing pipes 6 will be released, the connected series of casing pipes 6 will be pushed up by advancing unit 4 and 5 and the lowest casing pipe 6 will be clamped by the fastenings 10 of cylinders 9. Then the casing series 6 will be completed by further casing pipes 6 and will be pushed up higher with a length corresponding to the length of the first bore rod 7 or to the length of the first bore section. A caveat is that the length of the casing pipe series should not be longer than the bore rod 7, and that the bore crown 8 should not be torn loose from the bore rod 7. Then the boring machine 2 and the advancing unit 3 will be started and the former process repeated on the second boring section. When the hole is bored further to a length corresponding to the second bore rob 7, the second bore rod 7 will be fixed by fastenings 10 of cylinders 9 through the structure 11 according to FIG. 1 or the bore rod 7 will be clamped by fastenings 15 of the cylinders 14 and the lowest casing pipe 6, that is the whole casing series will be fixed by the clamps 13 of the cylinders 12. Then the boring machine 2 and the advancing unit 3 will be returned again to zero-setting, the first casing pipe 6 of the second boring section will be inlayed on the joint plate 5, the third bore rod 7 will be set in the first casing pipe 6 of the second boring section, the third bore rod 7 will be joined with the preceding bore rod 7, thereafter the first casing pipe of the second boring section will be pushed up and connected with the lowest casing pipe 6 of the preceding, first boring section, then this latest casing pipe 6 will be released, and the whole casing series will be pushed up, and the lowest casing pipe 6 will be fastened, while further casing pipes 6 will be pushed up, and thus the boring will be continued. These processes can be repeated entirely till the length required.

In the case when staggered casing is expedient, the process accomplished will be as follows. (FIG. 3). In the above stated manner, the boring length required for the first section will be bored, then the casing process will be executed with casing pipes of larger or (when more steps are required) largest diameter, in a convenient length. The casing process with casing pipes of smaller diameter will be accomplished as follows:

The bore rod 7 will be clamped by the fastenings 10 of the cylinders 9, then as many casing pipes 6′ of smaller diameter will be pushed up continuously so that the length of section supported by casing pipes 6 of larger diameter should be attained or the highest casing pipe 6′ should be at a distance of about 20–60 cm from the bore crown. Then the boring and the casing process shall continue in the above described manner as far as the required length of this section is attained. During this operation, the outer casing pipe series containing the casing pipes 6 of larger diameter will be clamped by the shrinking coal mass so that only the fixing of the inner casing pipe series 6′ is to be procured. This method of staggered casing has the advantage that while pushing up the casing pipe series, there is no need to overcome the clamping or frictional forces on the whole casing pipe series, because the outer casing pipe 6 remains in place, with only the inner casing pipes 6′ being advanced during positioning of these boring sections.

We claim:

1. A method of forming a hole between lower and upper parallel galleries formed in medium steeped and steep dip coal deposits and rock of loose structure, comprising the steps of:

(a) boring upwardly from said lower gallery with a boring crown at the end of an upright drill rod a bore hole having a first length equal to a fraction of the distance between said lower and upper galleries;

(b) casing said bore hole by thrusting upwardly independently of the upward advance of said drill rod at least one pipe section having a diameter sufficient to be gripped by the shrinkage of said bore hole into said bore hole to a point substantially adjacent said boring crown, whereby said drill rod extends through said pipe section;

(c) boring upwardly further after casing said first length with said at least one section by a further length equal to a fraction of the distance between said lower and upper galleries;

(d) casing the newly formed further length of said bore hole by thrusting upwardly through any previously disposed pipe sections into said newly formed further length of said bore hole at least one further pipe section so that said further pipe section extends beyond said previously disposed pipe sections, said one further pipe section having a diameter less than the inside diameter of said any pipe sections previously disposed in said bore hole and sufficient to be gripped by the shrinkage of the newly formed further length of the bore hole; and (e) repeating steps (c) and (d) until the upper gallery is reached.

* * * * *